US008770179B2

(12) United States Patent
Haynes et al.

(10) Patent No.: US 8,770,179 B2
(45) Date of Patent: Jul. 8, 2014

(54) CHEMICAL DISPERSAL APPARATUS SYSTEM

(75) Inventors: Robert W. Haynes, Morro Bay, CA (US); Eugene M. Maddux, Smarr, GA (US)

(73) Assignee: Pesticide Delivery Systems, Inc., Reno, NV (US)

( * ) Notice: Subject to any disclaimer, the term of this patent is extended or adjusted under 35 U.S.C. 154(b) by 130 days.

(21) Appl. No.: 13/472,097

(22) Filed: May 15, 2012

(65) Prior Publication Data

US 2012/0312289 A1 Dec. 13, 2012

Related U.S. Application Data

(60) Provisional application No. 61/495,666, filed on Jun. 10, 2011.

(51) Int. Cl.

| | |
|---|---|
| ***F41B 11/00*** | (2013.01) |
| ***F41A 21/32*** | (2006.01) |
| ***F41A 21/46*** | (2006.01) |
| ***F41B 11/80*** | (2013.01) |

(52) U.S. Cl.

CPC ..... *F41A 21/32* (2013.01); *F41A 21/46* (2013.01); *F41B 11/80* (2013.01)

USPC ..... 124/56; 42/76.01

(58) Field of Classification Search

CPC ..... F41A 21/32; F41A 21/46; F41B 11/80

USPC ..... 124/56, 81, 83; 42/76.01

See application file for complete search history.

(56) References Cited

U.S. PATENT DOCUMENTS

| | | | | |
|---|---|---|---|---|
| 889,644 | A | 6/1908 | Szemerey | |
| 4,030,421 | A | 6/1977 | Litman | |
| 4,040,331 | A * | 8/1977 | Litman | 89/14.3 |
| 5,046,276 | A | 9/1991 | Morris | |
| 5,452,535 | A * | 9/1995 | See et al. | 42/79 |
| 5,479,736 | A | 1/1996 | Forrester | |
| 6,306,913 | B1 | 10/2001 | Hayes et al. | |
| 7,350,449 | B2 * | 4/2008 | Franzen et al. | 89/1.701 |
| 7,421,935 | B2 | 9/2008 | Ho et al. | |
| 7,500,433 | B1 * | 3/2009 | Forrester | 102/454 |
| 7,603,998 | B2 | 10/2009 | Finstad | |
| 7,905,181 | B2 | 3/2011 | Ciesiun et al. | |
| 2006/0191525 | A1 | 8/2006 | Dai | |
| 2007/0193914 | A1 | 8/2007 | Scarabino | |

OTHER PUBLICATIONS

International Search Report of PCT/US2012/037990 dated Aug. 24, 2012.

* cited by examiner

*Primary Examiner* — Michael David

(74) *Attorney, Agent, or Firm* — Roberts Mlotkowski Safran & Cole, P.C.

(57) ABSTRACT

A system for airborne dispersal of chemicals comprising a compressed gas gun having a gun body, a grip, a barrel, a trigger, a compressed gas source and a cylindrical collar positioned at an exit end of said barrel, having a bore therethrough and equipped with a depth-adjustable knife-edge disposed at an exit end of the collar, protruding into the bore, so as to slit a capsule containing a chemical solution or suspension upon exit from the collar and disperse the chemical solution or suspension.

16 Claims, 1 Drawing Sheet

CHEMICAL DISPERSAL APPARATUS SYSTEM

FIELD

This invention relates to an apparatus and system for dispersing chemicals, such as agricultural chemicals, onto a targeted location.

BACKGROUND

A wide range of agricultural chemicals has been developed to increase agricultural production. Some of these chemicals, generally designated pesticides, are designed to eliminate competing plant growth or parasitic organisms. Consequently, the term pesticide includes a variety of products such as herbicides, insecticides, and fungicides. Another group of products, which is non-pesticidal in nature, is designed to maximize crop yields by acting directly on the crop itself. These non-pesticidal materials include, for example, plant growth regulators, insect growth regulators, micronutrients, and fertilizers.

Agricultural chemical products have been formulated as emulsifiable concentrates, wettable powders, dusts, water dispersible granules, baits, water soluble concentrates, water or oil based suspensions, and impregnated or extruded granules. These chemical products have been delivered to the target site using either ground or aerial equipment, specially adapted to handle the various product forms. For example, spraying equipment is used to deliver both water based dilute and concentrate sprays of active ingredients. Dry application of active ingredients in the form of dusts, baits, and granular products is also employed. And, chemigation, drip-line, and wick application techniques are commonly employed in the industry as well.

However, conventional methods of agricultural chemical dispersal are primarily designed for wide-spread application of these chemicals, over large areas such as crop fields and the like. It is often desirable to disperse agricultural chemicals and pesticides over a more limited area, even within enclosed areas, where conventional application methods are impractical. While such more limited dispersal can be effected by systems such as spray cans or hand-held pump sprayers, the effective distance of treatment of such devices is limited to only several feet from the outlet of the spray device, and the overall spray pattern can be quite limited, such that only spot treatment is effected.

It would be advantageous to be able to target delivery and dispersal of pesticides, such as agricultural chemicals, for treatment at distances, but to avoid the wide-spread treatment effected by, for example aircraft dispersal over entire crop fields. Several attempts have been disclosed at providing such systems.

U.S. Pat. No. 6,306,913 to Hayes et al. discloses use of a projectile, such as a paintball, to administer pesticides such as one or more from the group consisting of 4-allylanisole, anisole, allylbenzene, 4-isopropylanisole, p-anisaldehyde, ethylbenzene, cumene, 4-methoxyacetophenone, 4-methylstyrene, 2-propylphenol, phenetole, and toluene, for scolytid infestation. Conifers, which are a target for scolytids, are protected by the application of the pesticides by use of a projectile containing the compound which explodes upon contact with the conifer thereby emitting the compound.

U.S. Published Patent Application No. 2007/0193914 to Scarabino discloses a means to contain and deliver either liquids or solids to a predefined or targeted location. This invention allows the user to target locations that are either above the ground or are below the surface of the ground and deliver either a liquid or a solid to that location. The means disclosed is essentially a paintball filled with various pesticides and the like, which is delivered by means of a standard paintball gun.

However, neither of these disclosures addresses dispersal of agricultural chemicals/pesticides at distances between the exit of the firing device (i.e. the paintball gun) and the impact location of the chemical-filled paintball. As such, their effectiveness in chemical dispersal is limited to only a relatively small dispersal pattern at the impact site.

It would be advantageous to be able to disperse agricultural chemicals, such as pesticides or fertilizers, for treatment at distances between those susceptible to spray can or hand-held pump sprayer application, and the wide-spread treatment obtainable by, for example aircraft dispersal over entire crop fields.

SUMMARY

In one aspect, the invention resides in a cylindrical collar having first and second ends, an inner diameter defining a bore, an outer diameter and a thickness defined between the inner and outer diameters, comprising a depth-adjustable knife-edge protruding into and disposed axially to the bore.

In another embodiment, the invention is directed to a system for airborne dispersal of chemicals comprising a compressed gas gun having a gun body, a grip, a barrel, a trigger, a compressed gas source and a cylindrical collar positioned at an exit end of said barrel, having a bore therethrough and equipped with a depth-adjustable knife-edge disposed at an exit end of the collar, protruding into the bore, and a capsule containing a chemical solution or suspension.

In a third embodiment, the invention is directed to a process for dispersing a chemical solution or suspension onto a targeted area comprising shooting a capsule containing said chemical solution or suspension out of a compressed gas gun having a barrel, a bore within said barrel, and a knife-edge disposed at the distal end of the barrel and protruding into the bore, and slitting open the capsule with said knife-edge as it exits the gun.

BRIEF DESCRIPTION OF THE DRAWINGS

The following figures are provided to illustrate the invention, but are not intended to limit the scope of the invention in any way.

DETAILED DESCRIPTION OF THE EMBODIMENTS

Figure 1:
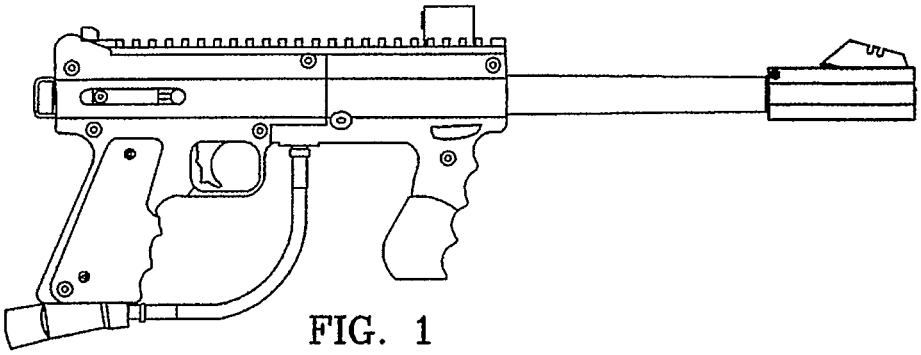
FIG. 1 is an illustration of the delivery system according to the present invention.
Figure 2:
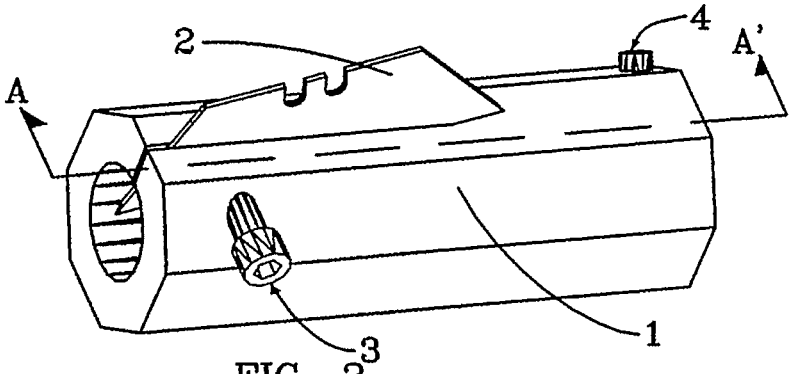
FIG. 2 is an expanded view of the collar apparatus according to the present invention.
Figure 3:
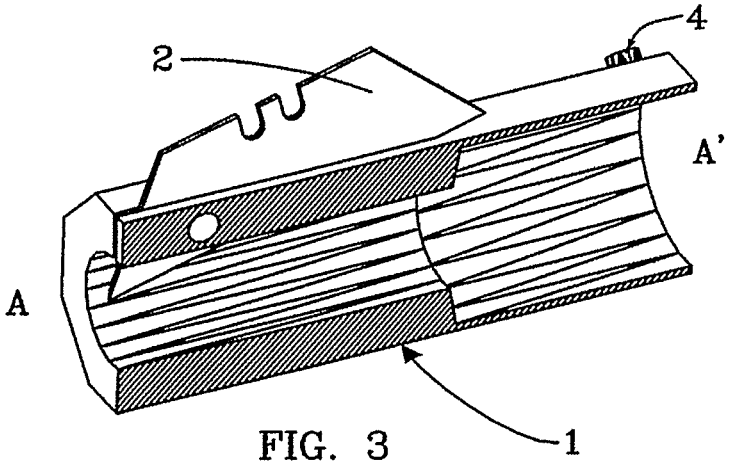
FIG. 3 is a sectional view of the collar apparatus of the present invention, along line A-A' of FIG. 2.

One embodiment of the present invention is directed to a system for airborne dispersal of chemicals comprising (FIG. 1) a compressed gas gun having a gun body, a grip, a barrel, a trigger, a compressed gas source (not shown) and as illustrated in FIG. 2, a cylindrical collar (1) positioned at an exit end of said barrel, having a bore therethrough and equipped with a depth-adjustable knife-edge (2) disposed at an exit end of the collar, protruding into the bore (FIGS. 2 and 3), and a capsule (not shown) containing a chemical solution or suspension. The capsule is typically a conventional paintballtype capsule which is filled not with paint but instead with a chemical solution or suspension to be delivered to a targeted area.

Unlike the systems disclosed in U.S. Pat. No. 6,306,913 and U.S. Published Patent Application No. 2007/0193914, described above, according to the present invention a compressed gas gun is equipped with a collar (1) disposed at the end of the barrel, and the collar has a knife-edge (2) extending into the bore thereof, designed to slit the paintball capsule as it exits the collar. Obviously, because the ball is slit, the chemical solution therein begins to exit through the slit immediately, unlike the prior art devices in which the chemical capsule/paintball remains intact until the point of impact.

It has been found that the depth of the slit has a considerable affect on both the distance of chemical delivery and the width of the spray pattern delivered by the system. Accordingly, adjusting the depth of protrusion of the knife-edge into the bore of the collar is based upon a desired pattern and/or distance of dispersion. Thus, it is advantageous if the knife-edge is essentially infinitely adjustable in depth into the bore, so as to provide the user with great variability in selecting the delivery parameters for the encapsulated chemical solutions/suspensions. For example, the depth of protrusion of the knife-edge can be controlled to slit the capsule to a depth of between about ⅛ inch and about ¾ inch to provide for chemical dispersion at a distance between about 1 foot and about 300 feet from the gun.

It is believed that the spray pattern is caused by rotation of the ball about its horizontal axis, imparted perhaps by the slight drag created on the ball during the slitting process as it exits the compressed gas gun/collar device. The rotation results in the chemical solution or suspension being forced out of the slit by centrifugal force, and the solution being spread in an areal pattern along it flight path.

An inverse correlation between the depth of the slit into the shell of the capsule/ball and the distance of chemical dispersal has been observed. That is, a deeper slit in the shell of the capsule results in earlier dispersal of the chemical solution within the ball, perhaps at a distance of only a few feet. This can be advantageous when the "target" is enclosed, such as when treating a barn for insects with an insecticide chemical. Alternatively, when a more distant target is desired, a shallower slit in the capsule shell results in the capsule travelling further and the chemical solution being retained within the ball over a longer distance, even as far as for example 300 feet or so. As would be expected, the width of the spray pattern is also affected by the depth of the slit, but generally correlates to the distance travelled by the solution as it exits the capsule. In any event, the width of the spray pattern can vary from only a few feet, perhaps 3 feet, or 5 feet, to as much as 8 or 10 feet along the flight path.

Additionally, retention of the chemical solution within the capsule can be controlled by varying the viscosity of the solution/suspension, by including well-known viscosity-modifying additives in the chemical solution/suspension.

Thus, by control of the slit depth, viscosity of the solution within the capsule and even the gas pressure ultimately applied to the system, agricultural chemicals can be economically and effectively applied to much smaller and more targeted areas, such as garden plots or flower gardens, which could not be economically treated by aerial spraying or other conventional wide-area application treatments.

The capsule typically has a spherical polymeric shell and a hollow core containing said chemical solution or suspension. The shell can be formed from thermoplastic polymers; for example polyolefins such as polyethylene (HDPE, LDPE, LLDPE), polypropylene, or other olefin-based polymers or copolymers; polyamides such as nylon-6 or nylon-6,6; and polyesters such as (poly)ethylene terephthalate (PET), or others well-known in the art. Those of skill in the art would know that the particular polymer selected should be compatible with the chemical/solution components to be encapsulated, such that on long term storage, the chemical does not permeate through the shell of the capsule.

As discussed above, the chemical comprises an agricultural chemical, such as a pesticide, an herbicide, a fungicide, an algaecide, a fertilizer or combinations thereof, which can be selected from among the many well-known pesticide chemicals currently approved for use in the field. Most often the chemical is soluble, or readily dispersible in water in combination with various adjuvants, such as solubilizers, surfactants, emulsifiers, thickeners and the like, and combinations of these, in minor amounts sufficient to impart their desired functions on the solution/suspension.

Manufacture of paintballs and encapsulation therein of paints is a process well-established in the art, and need not be repeated herein. According to the present invention, the conventional manufacturing process is merely modified to incorporate the desired agricultural chemical solution or suspension within the core of the paintball, in place of paint.

In one aspect, as more thoroughly illustrated in FIG. 2, the invention resides in a cylindrical collar (1) having first and second ends, an inner diameter defining a bore, an outer diameter and a thickness defined between the inner and outer diameters, comprising a depth-adjustable knife-edge (2) protruding into and disposed axially to the bore. The collar has an inner diameter sized such that said first end of the collar fits over a terminal end of a barrel of a paintball gun, and further comprises a locking screw or bolt (4) disposed through the thickness at the first end, such that the collar can be secured to the barrel of the compressed gas gun.

In the presently illustrated embodiments (FIGS. 1-3), the knife-edge is a simple razor blade (2) inserted into a slot through the thickness near the second end of the collar. While those skilled in the art will recognize that the depth-adjustable knife-edge can be configured to be of a different structure, such as one which is disposed on the end of a screw, threaded into the thickness of the collar, the disclosed razor blade has the advantage of being easily and economically replaceable when dulled. The knife-edge can be friction-fit into the slot, or the device can further comprise a set screw (3) positioned through the thickness of the collar at a non-zero angle to the axis of the bore, at a point sufficient to enable contact of the set screw with the razor blade and lock it in the slot at a desired depth of protrusion of the knife-edge into the bore. The set screw is positioned essentially orthogonal to and above the axis of the bore and the knife-edge is infinitely adjustable in depth into the bore, but disposed at a depth within the bore at least sufficient to result in penetration of the knife-edge entirely through the shell of the capsule, as discussed above.

The invention will now be more particularly described with reference to the following Examples. In the Examples, a conventional paintball was used in the apparatus of FIG. 1 in order to illustrate the spray patterns and distances which correlate with varying slit depths into the paintball. A paper covering was placed on the ground along the flight path of the ball, and on exiting from the ball, the paint deposited a readily observable spray pattern on the paper. The paint had a viscosity of 250 cP.

Example 1

This example was conducted to simulate dispersal of an insecticide for controlling mosquitoes in a backyard. Thus a short distance of flight with a higher deposition rate was desired. The adjustable knife-edge was positioned so as to penetrate the capsule to a depth of ¾ inch, to provide dispersal of the encapsulated solution in a short distance with a wide spray pattern. The paint exited the paintball within 25 yards and produced a spray pattern about 8 to 10 feet wide.

Example 2

This example was conducted to simulate dispersal of an herbicide along fence rows to eliminate weeds. Thus a long distance, narrow spray pattern was desired. The adjustable knife-edge was positioned so as to penetrate the capsule to a depth of only ⅛ inch. The paint exited the ball over a distance of 100 yards and produced a spray pattern width of between about 3 to 5 feet.

Example 3

This example was conducted to simulate spot treating of a target with a fungicide. Thus a medium distance, medium spray pattern was desired. The adjustable knife-edge was positioned so as to penetrate the capsule to a depth of ½ inch. The paint exited the ball over a distance of 50-75 yards and produced a spray pattern width of between about 6 and 8 feet.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

We claim:

1. A cylindrical collar having first and second ends, an inner diameter defining a bore sized to fit over a terminal end of a barrel of a paintball gun, an outer diameter and a thickness defined between the inner and outer diameters, a locking screw or bolt disposed through the thickness at the first end, and a depth-adjustable razor blade protruding into a slot through the thickness near the second end and disposed axially to the bore, wherein the razor blade is friction-fit into the slot, or locked therein by a set screw positioned through the thickness at a non-zero angle to the axis of the bore and into contact with the razor blade.

2. The cylindrical collar of claim 1, wherein the razor blade is locked by a set screw positioned essentially orthogonal to and above the axis of the bore.

3. The cylindrical collar of claim 1, wherein the razor blade is infinitely adjustable in depth into the bore.

4. A system for airborne dispersal of chemicals comprising:

a compressed gas gun having a gun body, a grip, a barrel, a trigger, a compressed gas source and a cylindrical collar according to claim 1 positioned at an exit end of said barrel; and a capsule containing a chemical solution or suspension.

5. The system of claim 4, wherein the capsule is sized to fit sealably but loosely within the bore and the fit is sufficient to permit gas pressure to build-up within the bore behind the capsule, and to expel the capsule from the barrel with said gas pressure.

6. The system of claim 4, wherein the capsule has a polymeric shell and a core containing said chemical solution or suspension.

7. The system of claim 6, wherein the shell polymer comprises a thermoplastic polymer.

8. The system of claim 4, wherein the chemical comprises an agricultural chemical.

9. The system of claim 8, wherein the agricultural chemical is a pesticide, an herbicide, a fungicide, an algaecide, a fertilizer or combinations thereof.

10. The system of claim 4, wherein the capsule is spherical.

11. A process for dispersing a chemical solution or suspension onto a targeted area comprising:

shooting a capsule containing said chemical solution or suspension out of a compressed gas gun having a barrel, a bore within said barrel, and a cylindrical collar according to claim 1 disposed at the distal end of the barrel; and slitting open the capsule with said razor blade as it exits the gun.

12. The process of claim 11, further comprising adjusting the depth of protrusion of the razor blade into said bore based upon a desired pattern and/or distance of dispersion.

13. The process of claim 11, wherein the chemical is an agricultural chemical.

14. The process of claim 11, further comprising dispersing said chemical solution or suspension from the slit in said capsule in a pattern over said targeted area.

15. The process of claim 12, wherein the depth of protrusion is controlled to slit the capsule to a depth of between about ⅛ inch and about ¾ inch to provide for dispersion at a distance between about 1 foot and about 300 feet from the gun.

16. The process of claim 15, wherein the dispersion pattern has a width between about 3 feet and about 10 feet, depending on the depth of protrusion.

* * * * *